US011536422B2

(12) United States Patent
Bartella et al.

(10) Patent No.: US 11,536,422 B2
(45) Date of Patent: Dec. 27, 2022

(54) ILLUMINATED ACOUSTIC CEILING ELEMENT AND ILLUMINATED ACOUSTIC CEILING SYSTEM

(71) Applicant: CertainTeed Canada, Inc., Woodbridge (CA)

(72) Inventors: Luigi Bartella, Toronto (CA); Timothy Briggs, Clinton, MA (US)

(73) Assignee: CertainTeed Canada, Inc., Woodbridge (CA)

( * ) Notice: Subject to any disclaimer, the term of this patent is extended or adjusted under 35 U.S.C. 154(b) by 0 days.

(21) Appl. No.: 17/127,467

(22) Filed: Dec. 18, 2020

(65) Prior Publication Data

US 2021/0190278 A1 Jun. 24, 2021

Related U.S. Application Data

(60) Provisional application No. 62/949,659, filed on Dec. 18, 2019.

(51) Int. Cl.

| | |
|---|---|
| ***F21S 8/02*** | (2006.01) |
| ***E04B 9/00*** | (2006.01) |
| ***F21Y 115/10*** | (2016.01) |
| ***F21V 33/00*** | (2006.01) |

(52) U.S. Cl.

CPC ..... *F21S 8/026* (2013.01); *E04B 9/001* (2013.01); *F21V 33/0056* (2013.01); *F21Y 2115/10* (2016.08)

(58) Field of Classification Search

CPC ..... E04B 9/001

See application file for complete search history.

(56) References Cited

U.S. PATENT DOCUMENTS

| | | | | |
|---|---|---|---|---|
| 9,506,643 | B1 * | 11/2016 | Rapisarda | A43B 23/24 |
| 2015/0109765 | A1 | 4/2015 | Sepkhanov et al. | |
| 2016/0123005 | A1 * | 5/2016 | Booij | F21S 4/28 362/235 |
| 2016/0178146 | A1 * | 6/2016 | Oleske | E04B 9/28 52/28 |
| 2016/0186942 | A1 * | 6/2016 | De Gier | F21S 8/026 362/234 |
| 2017/0130929 | A1 * | 5/2017 | Richter | F21V 11/14 |
| 2021/0025567 | A1 * | 1/2021 | Van Delden | F21S 8/026 |

FOREIGN PATENT DOCUMENTS

| | | | |
|---|---|---|---|
| CN | 207332073 | U | 5/2018 |
| DE | 202010003644 | U1 | 8/2010 |
| JP | H05-89630 | U | 12/1993 |
| WO | 2013/190447 | A2 | 12/2013 |

OTHER PUBLICATIONS

International Search Report for Int. App. No. PCT/US2020/066122, completed Apr. 2, 2021.

* cited by examiner

*Primary Examiner* — Eric T Eide

(74) *Attorney, Agent, or Firm* — McDonnell Boehnen Hulbert & Berghoff LLP

(57) ABSTRACT

The present disclosure relates generally to lighting elements, for example, suitable for use illuminating a ceiling. The present disclosure relates more particularly to an illuminated acoustic ceiling element including an acoustic substrate having an upper face and a lower face, an air permeable layer disposed under the lower face of the acoustic substrate and spaced from the acoustic substrate, and a light source supported by the acoustic substrate and configured to emit light through the air permeable layer.

15 Claims, 4 Drawing Sheets

ILLUMINATED ACOUSTIC CEILING ELEMENT AND ILLUMINATED ACOUSTIC CEILING SYSTEM

CROSS-REFERENCE TO RELATED APPLICATIONS

This application claims the benefit of priority of U.S. Provisional Patent Application No. 62/949,659, filed Dec. 18, 2019, which is hereby incorporated herein by reference in its entirety.

BACKGROUND OF THE DISCLOSURE

1. Field of the Disclosure

The present disclosure relates generally to lighting elements, for example, suitable for illuminating a ceiling. The present disclosure relates more particularly to an illuminated acoustic ceiling element and an illuminated acoustic ceiling system.

2. Technical Background

There are a variety of ways to provide lighting from a ceiling. Common options include surface mounted lamps, hanging lamps, track lighting, and recessed lighting. Another option is to have a portion of the ceiling surface be illuminated. A ceiling construction where a portion of the ceiling surface emits light has several attractive attributes. One unique characteristic of this type of ceiling construction is the ability to provide lighting from the ceiling without the need to include exposed lighting fixtures. Accordingly, the architect can design a ceiling layout that is uninterrupted by lighting fixtures, which provides a clean, simple aesthetic.

Although ceiling constructions with ceiling surfaces that emit light have an attractive appearance, the present inventors have identified various challenges with existing ceiling constructions that include this feature. With certain constructions, the ceiling layout is attractive, but the light emitted from the ceiling surface is unfavorable, for example due to variations in the light intensity. Further, with existing constructions, increased use of illuminated ceiling surfaces reduces the amount of surface that is covered with acoustic elements, such as acoustic ceiling tiles. Accordingly, the present inventors have recognized that a new ceiling construction that provides an illuminated ceiling surface would be attractive to architects and builders.

SUMMARY OF THE DISCLOSURE

In one aspect, the present disclosure provides an illuminated acoustic ceiling element comprising:

- an acoustic substrate including an upper face and a lower face;
- an air permeable layer disposed under the lower face of the acoustic substrate and spaced from the acoustic substrate; and
- a light source supported by the acoustic substrate and configured to emit light through the air permeable layer.

In another aspect, the disclosure provides an illuminated acoustic ceiling system comprising:

- a ceiling support structure; and
- at least one illuminated acoustic ceiling element according to the disclosure secured to the ceiling support structure.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

As described above, the present inventors have noted that existing illuminated ceiling constructions present various challenges. The present inventors have determined that a new ceiling construction that provides an illuminated acoustic ceiling would be desirable to architects and builders.

Figure 1:
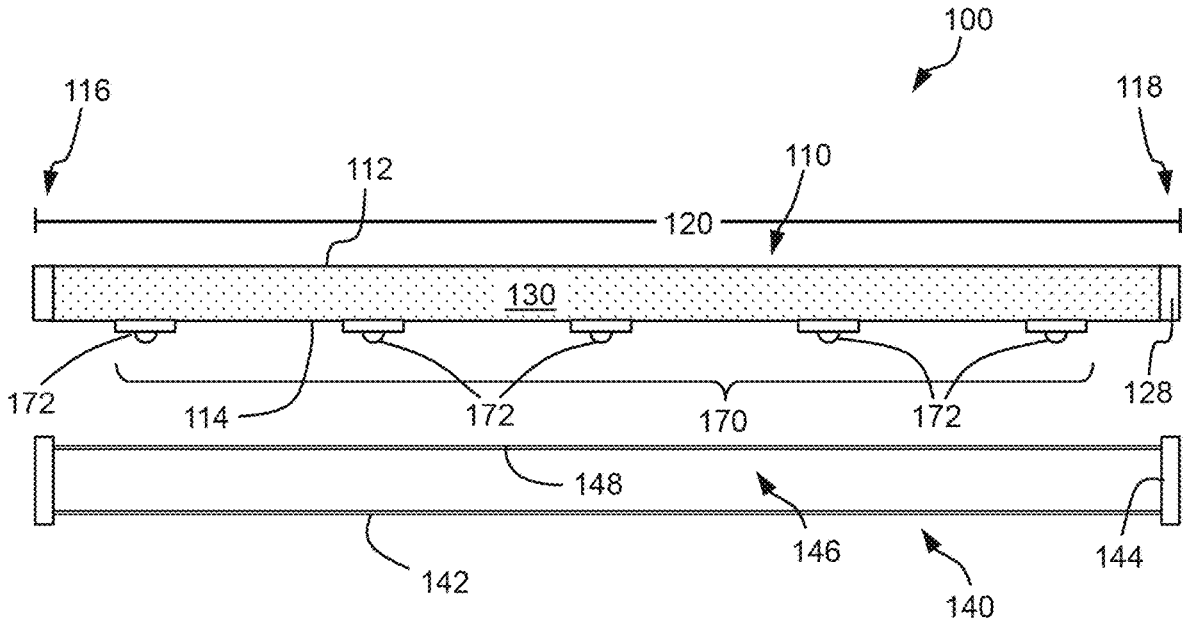
FIG. 1 is a schematic cross-sectional view of an illuminated acoustic ceiling element according to an embodiment of the disclosure.

Accordingly, one aspect of the disclosure is an illuminated acoustic ceiling element that includes an acoustic substrate having an upper face and a lower face, an air permeable layer disposed under the lower face of the acoustic substrate and is spaced from the acoustic substrate, and a light source supported by the acoustic substrate and configured to emit light through the air permeable layer. Such an illuminated acoustic ceiling element is shown in a cross-sectional side view in FIG. 1 and a perspective view in FIG. 2.

Figure 2:
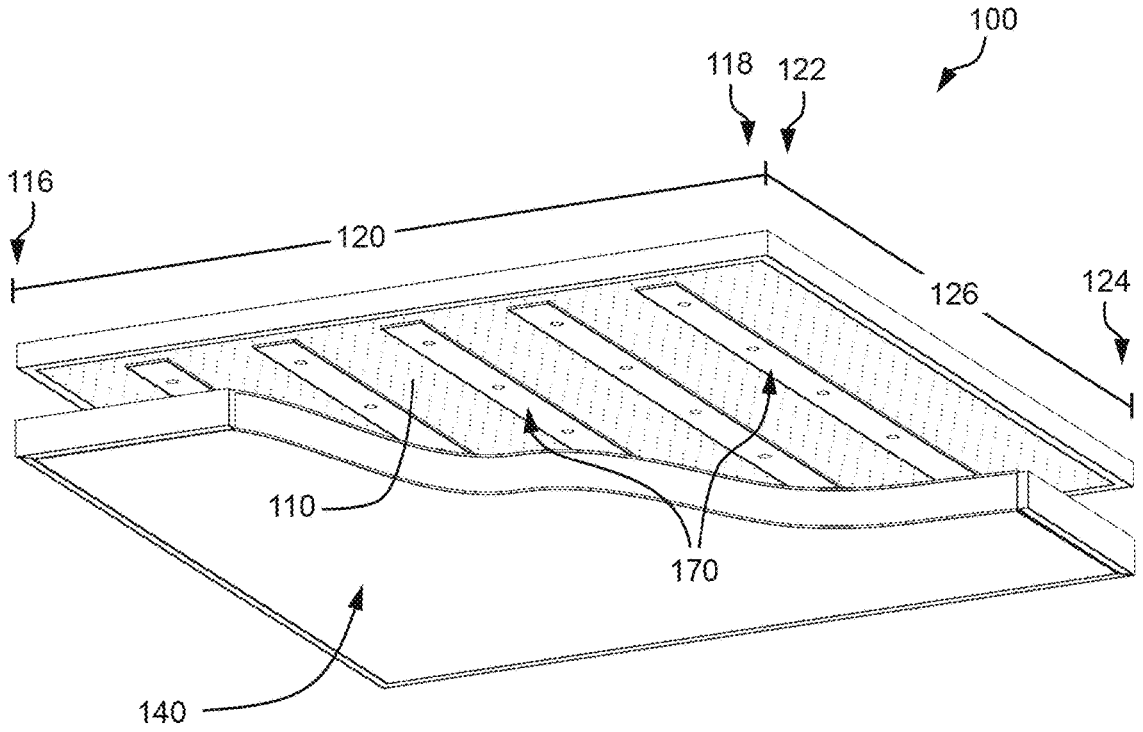
FIG. 2 is a perspective view of the illuminated acoustic ceiling element of FIG. 1.

Illuminated acoustic ceiling element 100 includes an acoustic substrate 110 having an upper face 112 and a lower face 114. The substrate 110 extends from a first end 116 to a second end 118 along a length 120, and from a first side 122 to a second side 124 along a width 126, as shown in FIG. 2. Illuminated acoustic ceiling element 100 also includes an air permeable layer 140 that is positioned under the lower face 114 of the acoustic substrate 110 and is spaced from the lower face 114 of acoustic substrate 110. A light source 170 is positioned between above air permeable layer 140 and is supported by acoustic substrate 110. Light source 170 is configured to emit light through air permeable layer 140 in order to illuminate the surface of air permeable layer 140 so that the ceiling element 100 is illuminated.

In certain embodiments of the illuminated acoustic ceiling element as otherwise described herein, the acoustic substrate includes a fiberglass panel. For example, in some embodiments, the acoustic substrate includes a panel formed of a body of non-woven glass fibers, which may be held together in a network. In some embodiments, the fiberglass panel includes a binder that holds the glass fibers together, while in other embodiments the fiberglass panel is free of any binder. Further in some embodiments the lower face of the fiberglass panel is painted or covered with a reflective layer, as described in more detail below, to enhance light reflectance. In some embodiments, the fiberglass panel has a density in a range of 4 to 15 lbs. per cubic foot, e.g., 5 to 10 lbs. per cubic foot, e.g., 6 to 7 lbs. per cubic foot.

In other embodiments, the acoustic substrate includes stone wool, felt, or foam. For example, in some embodiments, the majority of the acoustic substrate is formed of a body consisting of one or more of these lightweight materials. Further, in some embodiments, the acoustic substrate includes one or more of gypsum, wood fiber, paper or cellulose.

In some embodiments, the acoustic substrate is perforated or fissured to achieve a desired acoustic absorbency. Perforating and fissuring opens the panel surface and the internal structure of the acoustic panel to allow air and sound waves to move in and out of the substrate. Likewise, in some embodiments, the substrate is formed of an open cell foam. Similar to the perforations, the open cells of the foam allow air and sound waves to penetrate the substrate in order to dampen sound waves and reduce noise.

In certain embodiments of the illuminated acoustic ceiling element as otherwise described herein, the acoustic substrate has a thickness in a range from 0.5 inches to 3 inches. The term thickness, as used herein, refers to a measurement at a point through the body of the acoustic substrate from the upper face to the lower face. Thus, the term thickness does not incorporate the overall height dimension of the acoustic substrate that may result from curvature in the overall shape of the substrate. In other words, a curved acoustic substrate may have an overall height dimension of several inches, while the dimension of the material at any particular point on the surface of the panel is only 1 inch. As the term is used herein, the thickness of such a panel would be 1 inch. Moreover, in embodiments where the body of the acoustic substrate is porous or includes apertures, the thickness is measured from a planar boundary of the panel body defined at the lower face to an opposing planar boundary defined at the upper face.

In certain embodiments of the illuminated acoustic ceiling element as otherwise described herein, the acoustic substrate has a noise reduction coefficient of at least 0.4, e.g., at least 0.5, e.g., at least 0.7, e.g., at least 0.8, e.g., at least 0.85. As used herein, a "noise reduction coefficient" or "NRC" describes the arithmetic average (e.g., rounded to the nearest multiple of 0.05), of the absorption coefficients for a specific panel determined at 250 Hz, 500 Hz, 1000 Hz, and 2000 Hz. The person of ordinary skill in the art will appreciate that an "absorption coefficient" of a panel may be determined through standardized testing procedures such as, for example, ASTM C423 ("Standard Test Method for Sound Absorption and Sound Absorption Coefficients by the Reverberation Room Method"). The person of ordinary skill in the art will further appreciate that, while intended to describe the fraction of randomly incident sound power absorbed by a surface, an absorption coefficient is defined operationally, and accordingly, highly absorptive panels can have an absorption coefficient exceeding unity at one or more frequencies.

In certain embodiments of the illuminated acoustic ceiling element as otherwise described herein, the lower face of the acoustic substrate has a light reflectance of at least 75%, e.g., at least 80%, e.g., in a range from 85% to 95%. For example, as set forth above, in some embodiments the lower face of the acoustic substrate includes a reflective covering or is painted a bright color, such as white, in order to reflect light toward the air permeable layer. In other embodiments, the lower face of the acoustic substrate is dark and has lower light reflectance.

In certain embodiments of the illuminated acoustic ceiling element as otherwise described herein, the acoustic substrate is planar. For example, acoustic substrate 110 of illuminated acoustic ceiling element 100 is a planar rectangular element. Moreover each of the upper face 112 and lower face 114 are also planar. In other embodiments, the acoustic substrate is planar, while either or both of the upper face and lower face are non-planar. For example, in some embodiments, either or both of the upper face and lower face have a textured or an undulating profile, while the overall shape of the acoustic substrate is planar. The term planar, as used herein, refers to a shape having a length, width, and height, where the length and width are both substantially larger than the height, for example, the length and width are at least 10 times the height, or at least 20 times the height.

In certain embodiments of the illuminated acoustic ceiling element as otherwise described herein, the acoustic substrate includes a panel body supported by a panel frame. For example, acoustic substrate 110 of illuminated acoustic lighting element includes a perimeter frame 128 that extends around the side edge of a panel body 130. In some embodiments, the frame has a plurality of individual frame members that are joined to encompass the panel body. In certain embodiments, the frame is secured to the perimeter body using one or more adhesives, such as a white glue. In some embodiments, the frame is formed of a metal, for example, an extruded aluminum. In other embodiments, the frame may be formed of another material, such as a plastic. For example, the frame may be formed of PVC, ABS or another appropriate plastic as will be appreciated by those of ordinary skill in the art. In yet other embodiments, the frame may be made from a wood, such as a hard wood, softwood or wood composite or other appropriate construction material as known to those of ordinary skill in the art. In some embodiments, the frame includes a solid, continuous surface, while in other embodiments, the frame has openings or perforations to allow sound, heat or other forms of energy to move through the frame.

In certain embodiments of the illuminated acoustic ceiling element as otherwise described herein, the light source is secured to the lower face of the acoustic substrate. For example, light source 170 of illuminated acoustic ceiling element 100 is secured to lower face 114 of acoustic substrate 110. In some embodiments the light source is secured to the lower face of the acoustic substrate using an adhesive. In other embodiments, the light source is secured to the acoustic substrate using mechanical fasteners, such as staples or wires. Other fasteners for securing the light source to the acoustic substrate are also possible, as will be appreciated by those of ordinary skill in the art.

In certain embodiments of the illuminated acoustic ceiling element as otherwise described herein, the light source includes a plurality of LEDs. For example, light source 170 in illuminated acoustic ceiling element 100 includes a plurality of LEDs 172 secured to acoustic substrate 110. The term LED as used herein includes conventional LEDs, organic light emitting diodes (OLEDs) and quantum dot LEDs. In other embodiments, the light source may be in the form of a lamp, such as an incandescent, fluorescent, or halogen bulb. Still, in other embodiments, the light source may be in the form of another lighting element, such as a laser or an optical fiber.

In certain embodiments of the illuminated acoustic ceiling element as otherwise described herein, the plurality of LEDs are arranged in strips that extend laterally across the lower face of the acoustic substrate. For example, LEDs 172 that are part of light source 170 of illuminated acoustic ceiling element 100 are arranged in strips 174 that extend laterally across lower face 114 of acoustic substrate 110. The strips 174 are formed as elongate flexible circuit boards that include the LEDs 172 at regular intervals across the acoustic substrate 110. In some embodiments, the LED strips are electrically connected to one another, either in series or in parallel. In other embodiments, the strips are defined by lengths of wiring that include the LEDs along the length of the wires. Still in other embodiments, the LEDs are formed on strips that are all part of a shared printed circuit board.

In certain embodiments of the illuminated acoustic ceiling element as otherwise described herein, the plurality of LEDs are arranged in an array over the lower face of the acoustic substrate. For example, LEDs 172 of light source 170 in illuminated acoustic ceiling element 100 are arranged in array that includes a plurality of strips, with the LEDs of each strip aligned with the LEDs of neighboring strips in rows. In some embodiments, the LEDs are arranged in an array having the form of a square grid. In other embodiments, the LEDs in the array are staggered, such that the LEDs of each column are offset from those of a neighboring column. Still in other embodiments, the LEDs have another pattern.

In certain embodiments of the illuminated acoustic ceiling element as otherwise described herein, each of the LEDs is disposed at a distance from a neighboring LED in a range from 1 inch to 6 inches. The spacing of the LEDs influence both the luminance or brightness of the illuminated acoustic ceiling element as well as the uniformity of the light across the surface. Generally, the brightness of the illuminated acoustic ceiling element is established based on the brightness of each individual LED and the density of LEDs across the surface. For any given brightness, a larger number of LEDs, i.e., a higher density of LEDs can result in more uniform lighting across the element's surface.

In some embodiments, the LEDs are positioned in a uniform pattern, where the spacing between neighboring LEDs is uniform across the acoustic substrate surface. In other embodiments, the spacing of the LEDs varies. For example, in some embodiments, the LEDs are more closely packed in one area than another, such as at the perimeter of the acoustic substrate. Still, in other embodiments, the LEDs are arranged in another pattern.

In certain embodiments of the illuminated acoustic ceiling element as otherwise described herein, the acoustic substrate is formed by a single panel that extends across the length and the width of the illuminated acoustic ceiling element. For example, acoustic substrate 110 of illuminated acoustic ceiling element 100 is formed as a single panel that extends from the first end 116 to the second end 118 across the entire length of acoustic substrate 110.

Figure 3:
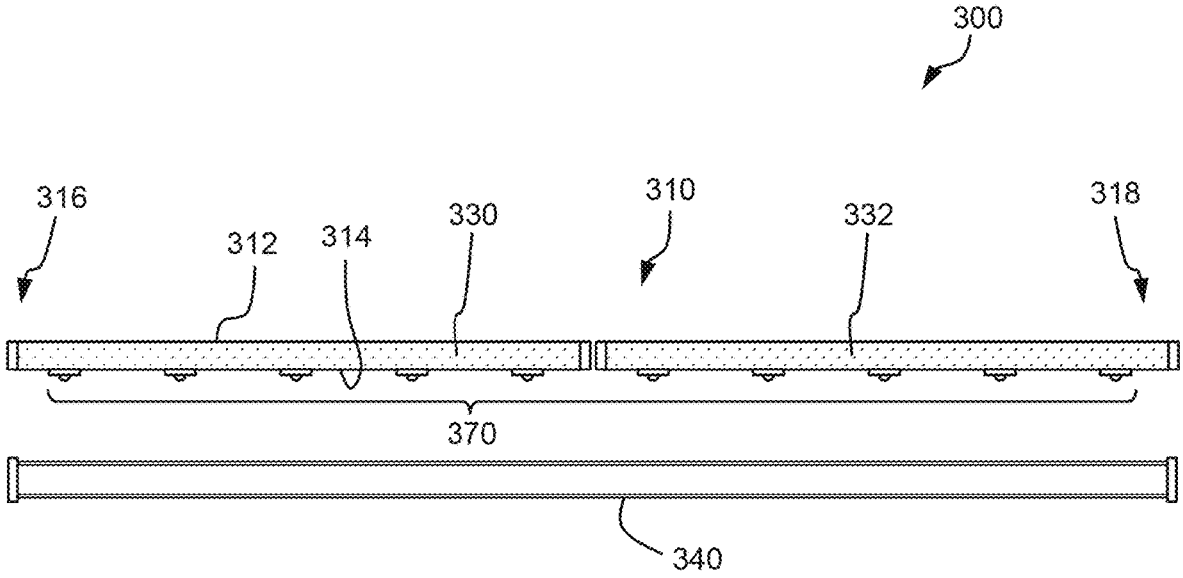
FIG. 3 is a schematic cross-sectional view of an illuminated acoustic ceiling element according to another embodiment of the disclosure.

On the other hand, in certain embodiments of the illuminated acoustic ceiling element as otherwise described herein, the acoustic substrate is formed by a plurality of acoustic panels. Such an illuminated acoustic ceiling element is shown in FIG. 3. Illuminated acoustic ceiling element 300 includes an acoustic substrate 310 that extends from a first end 316 to a second end 318. Further, acoustic substrate 310 includes a first acoustic panel 330 and a second acoustic panel 332 that are disposed adjacent to one another along the length of acoustic substrate 310. Acoustic substrate 310 also includes a lower face 314 that extends across both first acoustic panel 330 and second acoustic panel 332.

Illuminated acoustic ceiling element 300 also includes an air permeable layer 340 disposed below lower face 314 of acoustic substrate 310 as well as a light source 370 that is coupled to the acoustic panels 330, 332 and positioned between acoustic substrate 310 and air permeable layer 340.

In certain embodiments of the illuminated acoustic ceiling element as otherwise described herein, the air permeable layer is formed of a fabric. For example, air permeable layer 140 of illuminated acoustic ceiling element 100 includes a sheet of fabric 142 that is stretched between opposing members of a frame 144. Spaces between the fibers of the fabric allow the layer to be permeable to air, so that sound waves are not reflected and may reach the acoustic substrate. In some embodiments, the fabric is woven. In other embodiments is non-woven. Further, in certain embodiments, the fabric includes a synthetic polymer. For example, in some embodiments the fabric includes synthetic polymer fibers. Moreover, in some embodiments, the fabric includes a polymer coating. In certain embodiments, the fabric includes at least one of polyester and PVDF. In other embodiments, the fabric includes any of wide variety of synthetic polymers, as will be appreciated by those of ordinary skill in the art, including nylon, rayon, spandex or other polymer materials.

In certain embodiments of the illuminated acoustic ceiling element as otherwise described herein, the air permeable layer includes apertures configured to allow air to pass through the layer. For example, in some embodiments, the air permeable layer includes apertures that are machined or otherwise formed in the layer. Such apertures allow air to pass through the layer and reach the acoustic substrate. The apertures allow an otherwise air impermeable material to be used as the layer, such as a metal or plastic sheet. Further, the apertures can also be included in a fabric layer so as to increase the air flow provided through the air permeable layer.

In certain embodiments of the illuminated acoustic ceiling element as otherwise described herein, the illuminated acoustic ceiling element further includes a second air permeable layer disposed between the acoustic substrate and the air permeable layer. For example, illuminated acoustic ceiling element 100 includes a second air permeable layer 146 disposed between air permeable layer 140 and acoustic substrate 110. Like air permeable layer 140, second air permeable layer 146 is also permeable to air, so that sound waves can reach acoustic substrate 110. Furthermore, second layer 146 also includes a sheet of fabric 148 that is stretched between opposing members of the frame 144.

The use of a second air permeable layer can reduce or eliminate the likelihood that light from the light source can travel along a direct path to a viewer standing below the illuminated ceiling element. Such a direct path of light can be perceived as a bright spot on the surface of the illuminated surface forming a "star effect." The use of a second panel increases the likelihood that light from the light source cannot travel directly to a viewer, such as a person's eye or a camera.

In some embodiments, the air permeable layer and the second air permeable layer have the same characteristics. For example, in some embodiments, the air permeable layer and the second air permeable layer are formed of the same material. In other embodiments, the layers may be formed of a different material. Further, each of the air permeable layers may have any of the characteristics of the air permeable layer as described herein, independent of the characteristics of the other layer.

In certain embodiments of the illuminated acoustic ceiling element as otherwise described herein, the second layer is disposed at a distance from the air permeable layer in a range from ¼ inch to 4 inches, e.g., in a range from ½ inch to 2 inches. In other embodiments, the second layer is closer or further from the air permeable layer. Still, in other embodiments, the illuminated acoustic ceiling element does not include a second air permeable layer.

In certain embodiments of the illuminated acoustic ceiling element as otherwise described herein, the air permeable layer shifts the color of light from the light source, such that the color of light emitted from the ceiling element is different from the color of light emitted from the light source. The color shift resulting from the can be used to tint the light emitted from the illuminated surface of the ceiling element.

Figure 4:
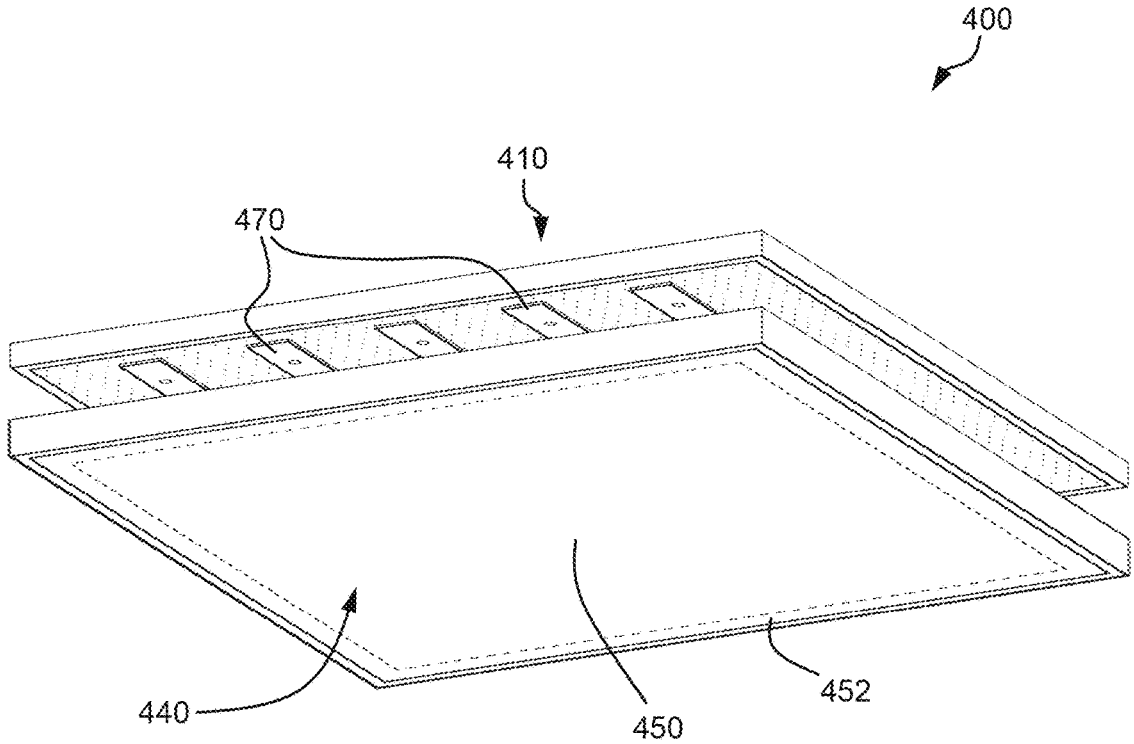
FIG. 4 is a schematic perspective view of an illuminated acoustic ceiling element according to another embodiment of the disclosure.

In certain embodiments of the illuminated acoustic ceiling element as otherwise described herein, the air permeable layer includes an interior area bound by a perimeter border, and wherein the light source is configured to illuminate the interior area such that the interior area emits light that has a substantially uniform brightness across the interior area. Such an illuminated acoustic ceiling element is shown in FIG. 4. Illuminated acoustic ceiling element 400 includes an acoustic substrate 410, a light source 470 supported by acoustic substrate 410 and an air permeable layer 440 disposed under light source 470. Air permeable layer 440 includes an interior area 450 that is bound on its sides by a perimeter border 452. The light source 470 is configured to illuminate the air permeable layer 440 so that light emitted from the interior area 450 of the air permeable layer 440 is substantially uniform. Accordingly, the individual light elements of light source 470 are not readily apparent, and the majority of the acoustic ceiling element appears uniformly illuminated. For example, in certain embodiments of the illuminated acoustic ceiling element as otherwise described herein, the light source is configured to illuminate the interior area such that the interior area emits light that varies no more than 20% across the interior area, e.g., light that varies no more than 15%, e.g., light that varies no more than 10%, e.g., light that varies no more than 5%.

In certain embodiments of the illuminated acoustic ceiling element as otherwise described herein, the perimeter border extends no more than 3 inches from an outer edge of the air permeable layer, e.g., no more than 2 inches, e.g., no more than 1 inch, e.g., no more than ½ inch, e.g., no more than ¼ inch. Accordingly, in some embodiments, the light emitted from the ceiling element is substantially uniform across the vast majority of the surface of the air permeable layer. In some embodiments, the light is substantially uniform across the entire air permeable layer. In other embodiments, the perimeter border is slightly darker than the interior area.

In certain embodiments of the illuminated acoustic ceiling element as otherwise described herein, the illuminated ceiling element has a width in a range from 1 foot to 10 feet, e.g., a range from 18 inches feet to 8 feet, e.g., from 2 feet to five feet. Further, in certain embodiments of the illuminated acoustic ceiling element as otherwise described herein, the illuminated ceiling element has a length in a range from 1 foot to 20 feet, e.g., a range from 18 inches feet to 10 feet, e.g., a range from 2 feet to 5 feet.

In certain embodiments of the illuminated acoustic ceiling element as otherwise described herein, the acoustic substrate and the air permeable layer are substantially the same size. For example, in illuminated acoustic ceiling element 100, acoustic substrate 110 and air permeable layer 140 are substantially the same size. Likewise, in illuminated acoustic ceiling element 300, acoustic substrate 310, formed by first acoustic panel 330 and second acoustic panel 332, is substantially the same size as air permeable layer 340. Further, in illuminated acoustic ceiling element 400, acoustic substrate 410 and air permeable layer 440 are substantially the same size. As used herein, substantially the same size includes embodiments where the surface area of the air permeable layer is equal to the surface area of the acoustic substrate, or where the surface area of the air permeable layer is up to 5% larger or up to 5% smaller than the surface area of the acoustic substrate. In other embodiments, the surface area of the air permeable layer is not substantially equal to the acoustic substrate. For example, in some embodiments, the acoustic substrate is smaller than the air permeable layer, and is positioned toward the center of the air permeable layer.

Figure 5:
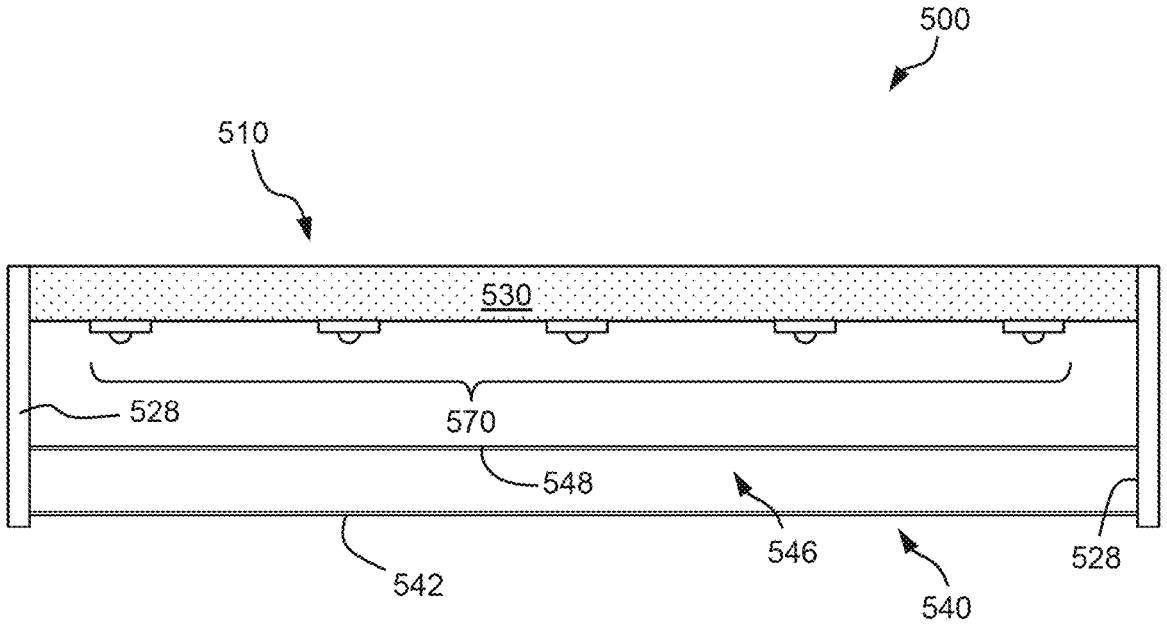
FIG. 5 is a schematic cross-sectional view of an illuminated acoustic ceiling element according to another embodiment of the disclosure.

In certain embodiments of the illuminated acoustic ceiling element as otherwise described herein, the acoustic substrate and the air permeable layer are supported by a shared perimeter frame. Such an illuminated acoustic ceiling element is shown in FIG. 5. Illuminated acoustic ceiling element 500 includes an acoustic substrate 510, a light source 570, a first air permeable layer 540 and a second air permeable layer 546. The acoustic substrate 510 includes an acoustic panel 530 that is supported by perimeter frame 528. Likewise, first air permeable layer 540 includes a sheet 542 that is stretched across perimeter frame 528 and second air permeable layer 546 also includes a sheet 548 stretched across perimeter frame 528. Accordingly, illuminated acoustic ceiling element 500 is provided as a combined structure that may be installed together. In other embodiments, the air permeable layers may be detached from the acoustic substrate and light source, such as in illuminated acoustic ceiling element 100.

Figure 6:
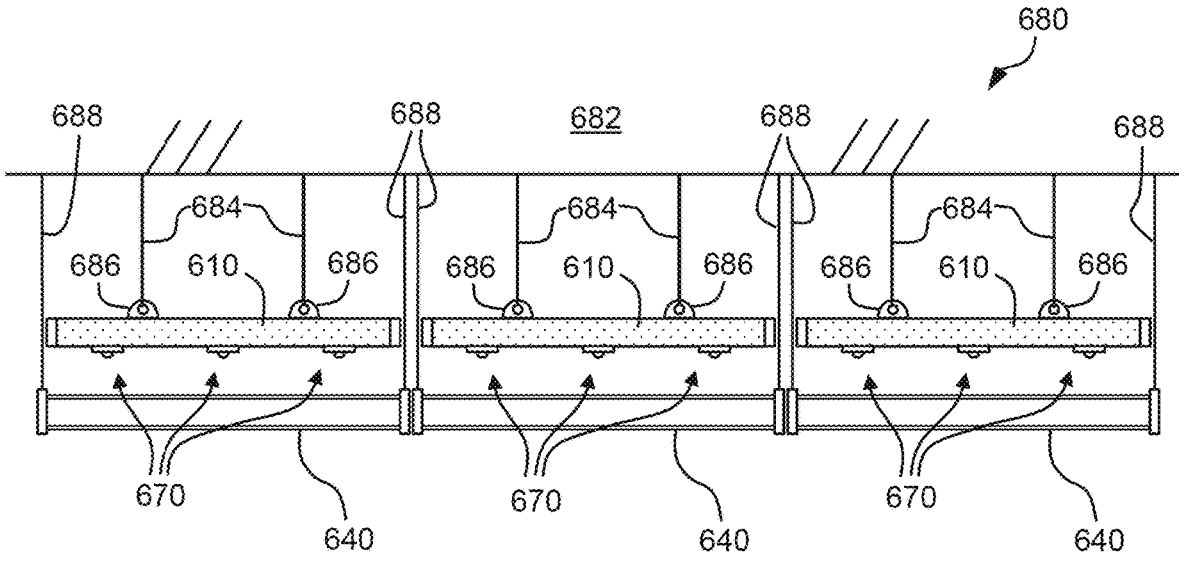
FIG. 6 is a schematic cross-sectional view of an illuminated acoustic ceiling system according to an embodiment of the disclosure.

In another aspect, the disclosure provides an illuminated acoustic ceiling system including a ceiling support structure, and an illuminated acoustic ceiling element according to the disclosure secured to the ceiling support structure. Such an illuminated acoustic ceiling system is shown in FIG. 6. Illuminated acoustic ceiling system 680 includes three illuminated acoustic ceiling elements 600 secured to ceiling support structure 682. Each of the illuminated acoustic ceiling elements 600 includes an acoustic substrate 610, an air permeable layer 640, and a light source 670 disposed between the acoustic substrate 610 and the air permeable layer 640.

In certain embodiments of the illuminated acoustic ceiling system as otherwise described herein, the acoustic substrate of each illuminated acoustic ceiling element is hung from the ceiling support structure. For example, in illuminated acoustic ceiling system 680, each of the acoustic substrates 610 is hung from ceiling support structure 682 by wire 684. Wire 684 is secured to acoustic substrate 610 using a mounted fastener 686. In other embodiments, the wire is secured to the acoustic substrate in another manner, for example, on a fastener disposed on a perimeter frame of the acoustic substrate.

In certain embodiments of the illuminated acoustic ceiling system as otherwise described herein, the air permeable layer of each illuminated acoustic ceiling element is hung from the ceiling support structure. For example, in illuminated acoustic ceiling system 680, each of the air permeable layers 640 is hung from ceiling support structure 682 by wire 688. The wire 688 is fastened to a perimeter frame of the air permeable layer 640.

Figure 7:
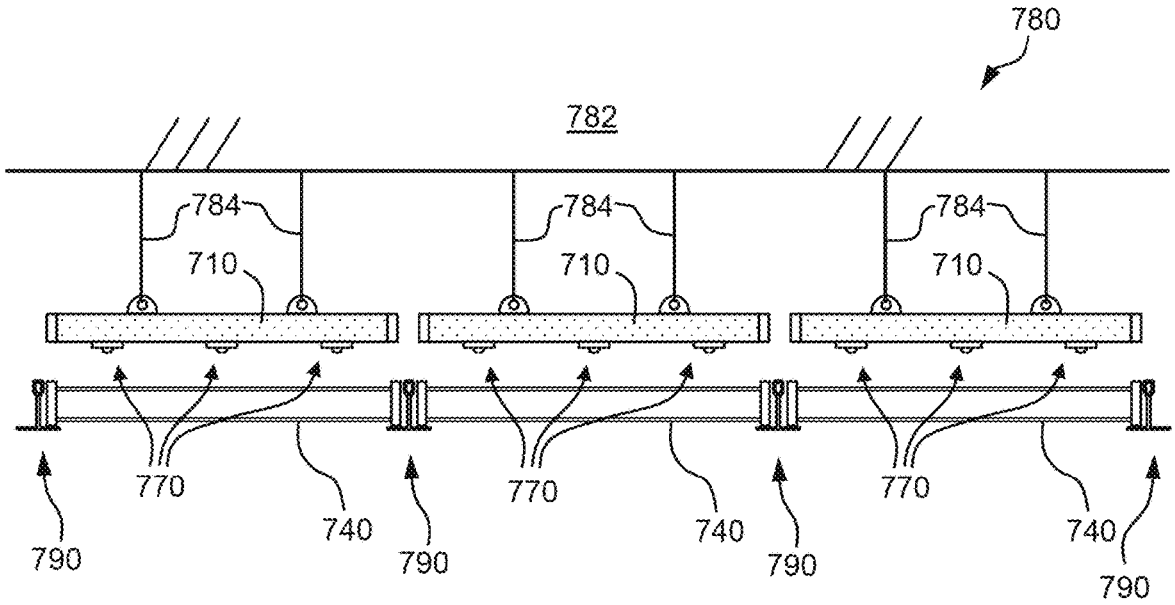
FIG. 7 is a schematic cross-sectional view of an illuminated acoustic ceiling system according to another embodiment of the disclosure.

In certain embodiments of the illuminated acoustic ceiling system as otherwise described herein, the ceiling support structure includes a first ceiling grid. For example, such an illuminated acoustic ceiling system is shown in FIG. 7. Illuminated acoustic ceiling system 780 includes three illuminated acoustic ceiling elements 700 secured to ceiling support structure 782. Each of the illuminated acoustic ceiling elements 700 includes an acoustic substrate 710, an air permeable layer 740, and a light source 770 disposed between the acoustic substrate 710 and the air permeable layer 740. Further, the ceiling support structure includes a first ceiling grid 790 formed by a plurality of T-bar grid members. In other embodiments, the first ceiling grid is formed of other types of grid members.

In certain embodiments of the illuminated acoustic ceiling system as otherwise described herein, the air permeable layer of each illuminated acoustic ceiling element is supported by first ceiling grid. For example, air permeable layers 740 of illuminated acoustic ceiling system 780 rest on the flanges of the grid members of first ceiling grid 790. In contrast, the acoustic substrate 710 of each illuminated acoustic ceiling system 780 is hung from the ceiling support structure 782 by wire 784. In other embodiments, the first ceiling grid supports the acoustic substrate. For example, in some embodiments, the acoustic substrate rests on the first ceiling grid while the air permeable membrane is hung from the first ceiling grid.

Figure 8:
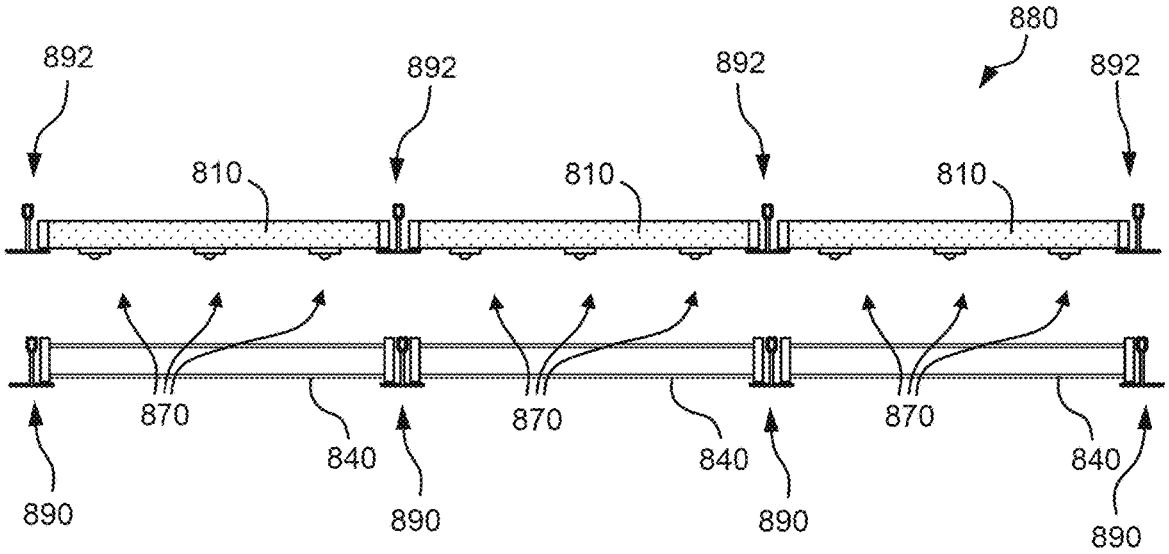
FIG. 8 is a schematic cross-sectional view of an illuminated acoustic ceiling system according to another embodiment of the disclosure.

In certain embodiments of the illuminated acoustic ceiling system as otherwise described herein, the ceiling support structure includes a second ceiling grid and wherein the acoustic substrate of each illuminated acoustic ceiling element is supported by the second ceiling grid. For example, such an illuminated acoustic ceiling system is shown in FIG. 8. Illuminated acoustic ceiling system 880 includes three illuminated acoustic ceiling elements 800 secured to ceiling support structure 882. Each of the illuminated acoustic ceiling elements 800 includes an acoustic substrate 810, an air permeable layer 840, and a light source 870 disposed between the acoustic substrate 810 and the air permeable layer 840. Further, the ceiling support structure includes a first ceiling grid 890 formed by a plurality of T-bar grid members. In other embodiments, the first ceiling grid is formed of other types of grid members. Further, illuminated acoustic ceiling system 880 also includes a second ceiling grid 892 and each of the acoustic substrates 810 are supported by the second ceiling grid 892. Similar to the first ceiling grid 890, second ceiling grid 892 is formed by T-bar grid members. In other embodiments, the second ceiling grid is formed of other types of grid members.

In certain embodiments of the illuminated acoustic ceiling system as otherwise described herein, the acoustic ceiling system includes a plurality of acoustic ceiling elements. For example, each of the illuminated acoustic ceiling systems 690, 790 and 890 includes three illuminated acoustic ceiling elements. In other embodiments, the illuminated acoustic ceiling system includes one, two or more than three illuminated acoustic ceiling elements. In still other embodiments, the illuminated acoustic ceiling elements are separated by non-illuminated ceiling elements, allowing for a variety of configurations and patterns.

In certain embodiments of the illuminated acoustic ceiling system as otherwise described herein, the illuminated acoustic ceiling elements are parallel. Further, in some embodiments, the illuminated acoustic ceiling elements are coplanar. A coplanar arrangement forms a continuous ceiling surface that extends across several illuminated acoustic ceiling elements. In other embodiments, the illuminated acoustic ceiling elements are staggered to form a ceiling structure with various heights. Still in other embodiments, the illuminated acoustic ceiling elements are disposed at an angle to one another to form a ceiling structure with angled surfaces.

Various aspects of the disclosure are further described by the following enumerated embodiments, which may be combined in any number and in any fashion not logically or technically Embodiment 1. An illuminated acoustic ceiling element comprising:

an acoustic substrate including an upper face and a lower face;

an air permeable layer disposed under the lower face of the acoustic substrate and spaced from the acoustic substrate; and a light source supported by the acoustic substrate and configured to emit light through the air permeable layer.

Embodiment 2. The illuminated acoustic ceiling element according to embodiment 1, wherein the acoustic substrate includes a fiberglass panel.

Embodiment 3. The illuminated acoustic ceiling element according to embodiment 1, wherein the acoustic substrate includes stone wool, felt, or foam.

Embodiment 4. The illuminated acoustic ceiling element according to any of embodiments 1 to 3, wherein the acoustic substrate has a thickness in a range from 0.5 inches to 3 inches.

Embodiment 5. The illuminated acoustic ceiling element according to any of embodiments 1 to 4, wherein the acoustic substrate has a noise reduction coefficient of at least 0.4, e.g., at least 0.5, e.g., at least 0.7, e.g., at least 0.8, e.g., at least 0.85.

Embodiment 6. The illuminated acoustic ceiling element according to any of embodiments 1 to 5, wherein the lower face of the acoustic substrate has a light reflectance of at least 75%, e.g., at least 80%, e.g., in a range from 85% to 95%.

Embodiment 7. The illuminated acoustic ceiling element according to any of embodiments 1 to 6, wherein the acoustic substrate is planar.

Embodiment 8. The illuminated acoustic ceiling element according to any of embodiments 1 to 7, wherein the acoustic substrate includes a panel body supported by a panel frame.

Embodiment 9. The illuminated acoustic ceiling element according to any of embodiments 1 to 8, wherein the light source is secured to the lower face of the acoustic substrate.

Embodiment 10. The illuminated acoustic ceiling element according to any of embodiments 1 to 9, wherein the light source includes a plurality of LEDs.

Embodiment 11. The illuminated acoustic ceiling element according to embodiment 10, wherein the plurality of LEDs are arranged in strips that extend laterally across the lower face of the acoustic substrate.

Embodiment 12. The illuminated acoustic ceiling element according to embodiment 10 or embodiment 11, wherein the plurality of LEDs are arranged in an array over the lower face of the acoustic substrate.

Embodiment 13. The illuminated acoustic ceiling element according to any of embodiments 10 to 12, wherein each of the LEDs is disposed at a distance from a neighboring LED in a range from 1 inch to 6 inches.

Embodiment 14. The illuminated acoustic ceiling element according to any of embodiments 1 to 13, wherein the acoustic substrate is formed by a single panel that extends across the length and the width of the illuminated acoustic ceiling element.

Embodiment 15. The illuminated acoustic ceiling element according to any of embodiment 1 to 13, wherein the acoustic substrate is formed by a plurality of acoustic panels.

Embodiment 16. The illuminated acoustic ceiling element according to any of embodiments 1 to 15, wherein the air permeable layer is formed of a fabric.

Embodiment 17. The illuminated acoustic ceiling element according to embodiment 16, wherein the fabric is woven.

Embodiment 18. The illuminated acoustic ceiling element according to embodiment 16, wherein the fabric is non-woven.

Embodiment 19. The illuminated acoustic ceiling element according to any of embodiments 16 to 18, wherein the fabric includes a synthetic polymer.

Embodiment 20. The illuminated acoustic ceiling element according to embodiment 19, wherein the fabric includes at least one of polyester and PVDF.

Embodiment 21. The illuminated acoustic ceiling element according to any of embodiments 1 to 20, wherein the air permeable layer includes apertures configured to allow air to pass through the layer.

Embodiment 22. The illuminated acoustic ceiling element according to any of embodiments 1 to 21, further comprising a second air permeable layer disposed between the acoustic substrate and the air permeable layer.

Embodiment 23. The illuminated acoustic ceiling element according embodiment 22, wherein the second air permeable layer is disposed at a distance from the air permeable layer in a range from ¼ inch to 4 inches, e.g., in a range from ½ inch to 2 inches.

Embodiment 24. The illuminated acoustic ceiling element according to any of embodiments 1 to 23, wherein the air permeable layer shifts the color of light from the light source, such that the color of light emitted from the ceiling element is different from the color of light emitted from the light source.

Embodiment 25. The illuminated acoustic ceiling element according to any of embodiments 1 to 24, wherein the air permeable layer includes an interior area bound by a perimeter border, and wherein the light source is configured to illuminate the interior area such that the interior area emits light that has a substantially uniform brightness across the interior area.

Embodiment 26. The illuminated acoustic ceiling element according to embodiment 25, wherein the light source is configured to illuminate the interior area such that the interior area emits light that varies no more than 20% across the interior area, e.g., light that varies no more than 15%, e.g., light that varies no more than 10%, e.g., light that varies no more than 5%.

Embodiment 27. The illuminated acoustic ceiling element according to embodiment 25 or embodiment 26, wherein the perimeter border extends no more than 3 inches from an outer edge of the air permeable layer, e.g., no more than 2 inches, e.g., no more than 1 inch, e.g., no more than ½ inch, e.g., no more than ¼ inch.

Embodiment 28. The illuminated acoustic ceiling element according to any of embodiments 1 to 27, wherein the illuminated ceiling element has a width in a range from 1 foot to 10 feet, e.g., a range from 18 inches feet to 8 feet, e.g., from 2 feet to five feet.

Embodiment 29 The illuminated acoustic ceiling element according to any of embodiments 1 to 28, wherein the illuminated ceiling element has a length in arrange from 1 foot to 20 feet, e.g., a range from 18 inches feet to 10 feet, e.g., a range from 2 feet to 5 feet.

Embodiment 30. The illuminated acoustic ceiling element according to any of embodiments 1 to 29, wherein the acoustic substrate and the air permeable layer are substantially the same size.

Embodiment 31. The illuminated acoustic ceiling element according to any of embodiments 1 to 30, wherein the acoustic substrate and the air permeable layer are supported by a shared perimeter frame.

Embodiment 32. An illuminated acoustic ceiling system comprising:

a ceiling support structure; and an illuminated acoustic ceiling element according to any of embodiments 1 to 31 secured to the ceiling support structure.

Embodiment 33. The illuminated acoustic ceiling system according to embodiment 32, wherein the acoustic substrate of each illuminated acoustic ceiling element is hung from the ceiling support structure.

Embodiment 34. The illuminated acoustic ceiling system according to embodiment 32 or 33, wherein the air permeable layer of each illuminated acoustic ceiling element is hung from the ceiling support structure.

Embodiment 35. The illuminated acoustic ceiling system according to embodiment 32 or embodiment 33, wherein the ceiling support structure includes a first ceiling grid.

Embodiment 36. The illuminated acoustic ceiling system according to embodiment 35, wherein the air permeable layer of each illuminated acoustic ceiling element is supported by the first ceiling grid.

Embodiment 37. The illuminated acoustic ceiling system according to embodiment 36, wherein the ceiling support structure includes a second ceiling grid and wherein the acoustic substrate of each illuminated acoustic ceiling element is supported by the second ceiling grid.

Embodiment 38. The illuminated acoustic ceiling system according to embodiment 35, wherein the acoustic substrate is supported by the first ceiling grid.

Embodiment 39. The illuminated acoustic ceiling system according to any of embodiments 32 to 38, further comprising another illuminated acoustic ceiling element according to any of embodiments 1 to 31 secured to the ceiling support structure.

Embodiment 40. The illuminated acoustic ceiling system according to embodiment 39, wherein the illuminated acoustic ceiling elements are parallel.

Embodiment 41. The illuminated acoustic ceiling system according to embodiment 39, wherein the illuminated acoustic ceiling elements are coplanar.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. An illuminated acoustic ceiling system, comprising:

a ceiling support structure; and an acoustic substrate including an upper face and a lower face;

an air permeable layer including a sheet of fabric stretched across a frame, wherein the air permeable layer is disposed under the lower face of the acoustic substrate and spaced from the acoustic substrate;

a second air permeable layer including a sheet of fabric stretched across the frame, wherein the second air permeable layer is spaced from the air permeable layer and is disposed between the acoustic substrate and the air permeable layer; and a light source supported by the acoustic substrate and configured to emit light through the air permeable layer, wherein the air permeable layer and the second air permeable layer are formed of the same material, wherein the illuminated acoustic ceiling element is secured to the ceiling support structure, wherein the ceiling support structure includes a first ceiling grid, and wherein the air permeable layer is supported by the first ceiling grid, and wherein the ceiling support structure includes a second ceiling grid, and wherein the acoustic substrate is supported by the second ceiling grid.

2. The illuminated acoustic ceiling element according to claim 1, wherein the acoustic substrate includes a fiberglass panel, and/or includes stone wool, felt, or foam.

3. The illuminated acoustic ceiling element according to claim 1, wherein the acoustic substrate has a noise reduction coefficient of at least 0.7.

4. The illuminated acoustic ceiling element according to claim 1, wherein the lower face of the acoustic substrate has a light reflectance of at least 80%.

5. The illuminated acoustic ceiling element according to claim 1, wherein the acoustic substrate includes a panel body supported by a panel frame.

6. The illuminated acoustic ceiling element according to claim 1, wherein the light source is secured to the lower face of the acoustic substrate.

7. The illuminated acoustic ceiling element according to claim 1, wherein the light source includes a plurality of LEDs.

8. The illuminated acoustic ceiling element according to claim 1, wherein the acoustic substrate is formed by a single panel that extends across the length and the width of the illuminated acoustic ceiling element.

9. The illuminated acoustic ceiling element according to claim 1, wherein the air permeable layer includes apertures configured to allow air to pass through the layer.

10. The illuminated acoustic ceiling element according claim 1, wherein the distance between the air permeable layer and the second air permeable layer is in a range from ½ inch to 2 inches.

11. The illuminated acoustic ceiling element according to claim 1, wherein the air permeable layer shifts the color of light from the light source, such that the color of light emitted from the ceiling element is different from the color of light emitted from the light source.

12. The illuminated acoustic ceiling element according to claim 1, wherein the air permeable layer includes an interior area bound by a perimeter border, and wherein the light source is configured to illuminate the interior area such that the interior area emits light that has a substantially uniform brightness across the interior area.

13. The illuminated acoustic ceiling element according to 14, wherein the perimeter border extends no more than 1 inch from an outer edge of the air permeable layer.

14. The illuminated acoustic ceiling element according to claim 1, wherein the acoustic substrate and the air permeable layer are substantially the same size.

15. The illuminated acoustic ceiling element according to claim 1, wherein the acoustic substrate is supported by the frame.

* * * * *